US006945057B2

(12) United States Patent
Hwang et al.

(10) Patent No.: US 6,945,057 B2
(45) Date of Patent: Sep. 20, 2005

(54) ICE MAKER

(75) Inventors: Ji Sick Hwang, Kwangiu (KR); Myung-Wouk Kim, Kwangiu (KR); Jae Seung Lee, Kwangiu (KR); Sang Gyu Jung, Kwangiu (KR); Gil Hyoung Cho, Yongin-si (KR); Sung Jun Hyun, Osan (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/790,701

(22) Filed: Mar. 3, 2004

(65) Prior Publication Data

US 2004/0237566 A1 Dec. 2, 2004

(30) Foreign Application Priority Data

May 27, 2003 (KR) ..... 10-2003-033724

(51) Int. Cl.[7] ..... F25C 5/08
(52) U.S. Cl. ..... 62/73; 62/264; 62/351
(58) Field of Search ..... 62/66–74, 264, 62/340–356

(56) References Cited

U.S. PATENT DOCUMENTS 3,199,309 A * 8/1965 Brubuker ..... 62/345
3,253,425 A * 5/1966 McKissick ..... 62/345
3,285,029 A * 11/1966 Pansing ..... 62/135
3,309,892 A * 3/1967 O'Connell et al. ..... 62/345
3,580,007 A * 5/1971 Bauerlein ..... 62/345
3,791,166 A * 2/1974 Mateck ..... 62/138

FOREIGN PATENT DOCUMENTS

JP 2000-88414 3/2000

* cited by examiner

*Primary Examiner*—William E. Tapolcai
(74) *Attorney, Agent, or Firm*—Staas & Halsey LLP

(57) ABSTRACT

An ice maker capable of efficiently making and removing ice cubes. The ice maker includes first and second pulleys, a drive unit, an ice making conveyor, heat/light generating units, and a reflecting member. The first and second pulleys are spaced apart from each other. The drive unit rotates the first and second pulleys. The ice making conveyor is wrapped around the first and second pulleys, and has a plurality of ice making parts which are concavely formed to contain water therein. The heat/light generating units are located in an interior of the ice making conveyor. The reflecting member covers upper and side portions of the heat/light generating units to downwardly reflect and guide heat and the light generated from the heat/light generating units. The ice maker is provided with the heat/light generating units and the reflecting member, thus allowing ice cubes to be efficiently removed from ice making parts located under the heat/light generating units, and minimizing the amount of energy transmitted to the ice making parts located above the heat/light generating units.

19 Claims, 2 Drawing Sheets

ICE MAKER

CROSS-REFERENCE TO RELATED APPLICATIONS

This application claims the benefit of Korean Patent Application No. 2003-33724, filed on May 27, 2003 in the Korean Intellectual Property Office, the disclosure of which is incorporated herein by reference.

BACKGROUND OF THE INVENTION

1. Field of the Invention

The present invention relates, in general, to ice makers and, more particularly, to an ice maker capable of efficiently making and removing ice cubes.

2. Description of the Related Art

Generally, an ice maker is installed in a refrigerator or a vending machine to make ice cubes with water supplied to the ice maker.

A conventional ice maker includes drive and driven pulleys spaced apart from each other by a predetermined distance. An ice making conveyor is wrapped around the drive and driven pulleys, and is provided with a plurality of ice making parts to contain water therein. Further, a heater is installed in an interior of the ice making conveyor to apply heat to lower ice making parts which face downward, thus removing the ice cubes from the lower ice making parts.

Thus, when the ice cubes are formed in the ice making parts which face upward, the ice making conveyor is moved by the drive and driven pulleys to make the ice making parts having the ice cubes face downward. Thereafter, electricity is applied to the heater to generate heat. The ice cubes are removed from the ice making parts by the heat.

However, the conventional ice maker has a problem in that the heat generated by the heater affects the upper ice making parts in which the ice cubes are being formed, as well as the lower ice making parts, thus it takes longer time to form the ice cubes in the upper ice making parts.

SUMMARY OF THE INVENTION

Accordingly, it is an aspect of the present invention to provide an ice maker capable of efficiently making and removing ice cubes.

Additional aspects and/or advantages of the invention will be set forth in part in the description which follows and, in part, will be obvious from the description, or may be learned by practice of the invention.

The foregoing and/or other aspects are achieved by an ice maker comprising first and second pulleys spaced apart from each other, a drive unit to rotate the first and second pulleys, an ice making conveyor wrapped around the first and second pulleys and having a plurality of ice making parts concavely formed to contain water therein, a heat/light generating unit located an interior of the ice making conveyor to generate heat and light, and a reflecting member to downwardly reflect the heat and the light generated from the heat/light generating unit.

The heat/light generating unit further comprises a halogen lamp to generate the heat and light.

The reflecting member comprises an arc-shaped cross-section to cover upper and side portions of the heat/light generating unit, to downwardly guide the heat and the light generated from the heat/light generating unit.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
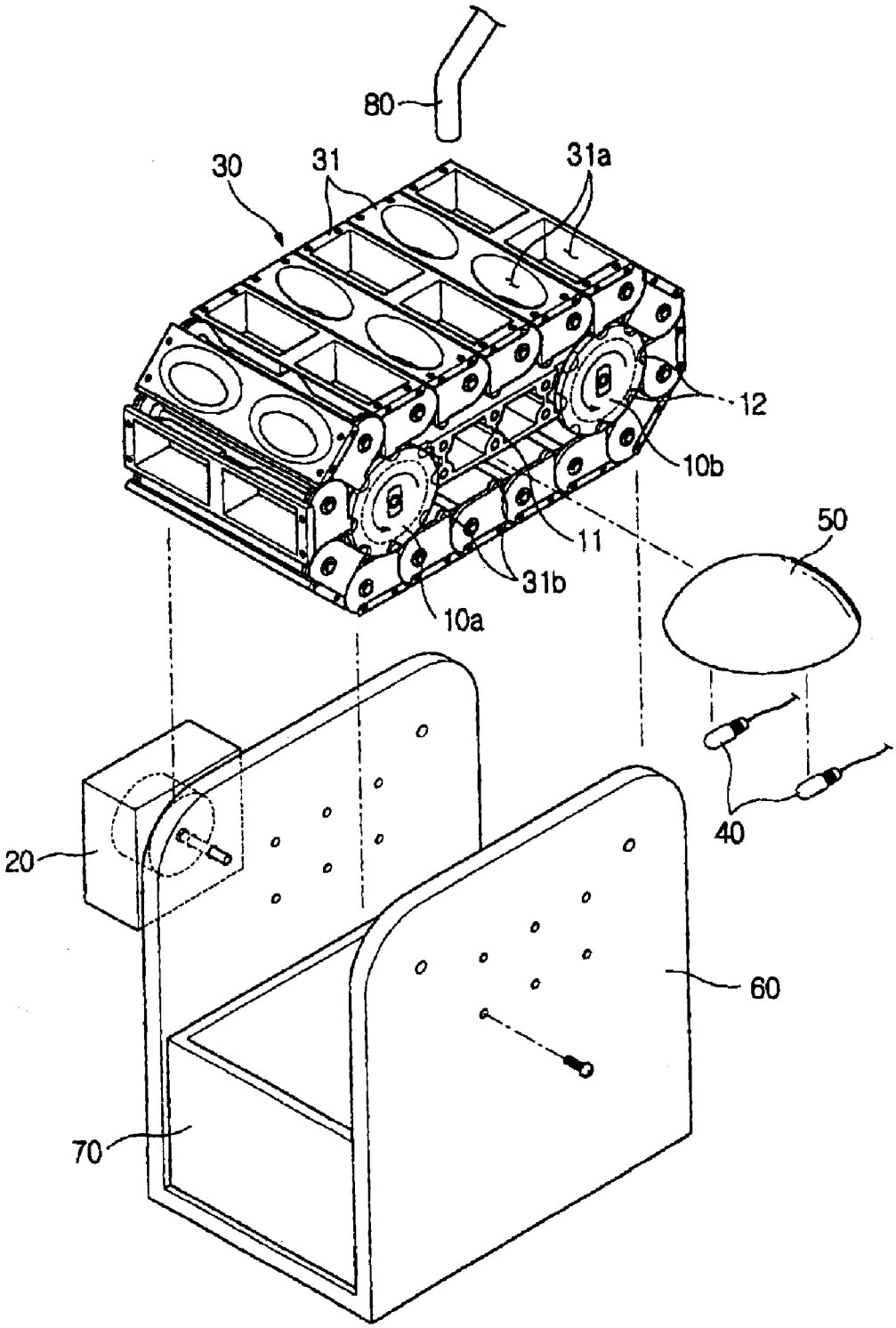
FIG. 1 is an exploded perspective view of an ice maker, according to an embodiment of the present invention.

Reference will now be made in detail to an embodiment of the present invention, examples of which are illustrated in the accompanying drawings, wherein like reference numerals refer to like elements throughout. The embodiment is described below in to explain the present invention by referring to the figures.

Figure 2:
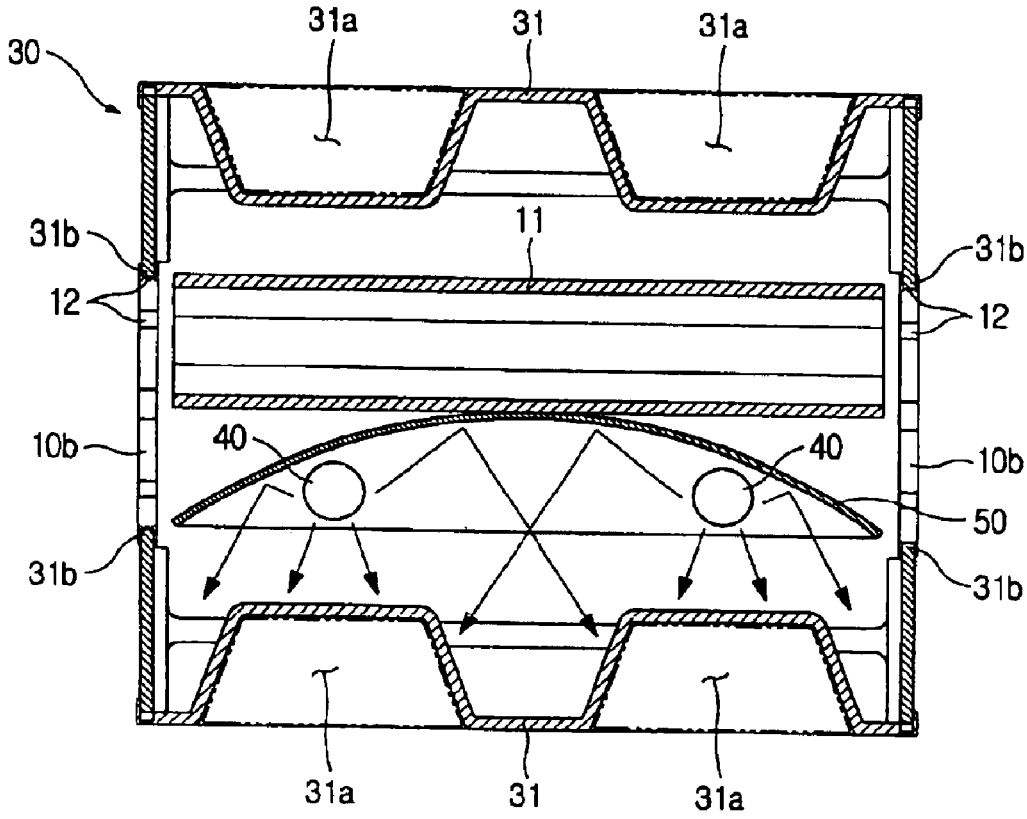
FIG. 2 is a sectional view of the ice maker of FIG. 1.

In FIGS. 1 and 2, an ice maker according to the present invention comprises first and second pulleys 10*a* and 10*b* spaced apart from each other by a predetermined distance. A drive unit 20 rotates the first and second pulleys 10*a* and 10*b*. An ice making conveyor 30 is wrapped around the first and second pulleys 10*a* and 10*b*.

The first pulley 10*a* comprises a drive pulley 10*a* which is rotated by power transmitted from the drive unit 20. The second pulley 10*b* comprises a driven pulley 10*b* which is rotated by the power transmitted from the first pulley 10*a* through the ice making conveyor 30. A support bracket 11 is included between the drive and driven pulleys 10*a* and 10*b*. The drive and driven pulleys 10*a* and 10*b* are respectively installed at opposite ends of the support bracket 11 to be spaced apart from each other by a predetermined distance.

The ice making conveyor 30 comprises tray cells 31 having concave ice making parts 31*a*. The tray cells 31 are hinged to each other to form the ice making conveyor 30 in a closed-loop shape. Each of the ice making parts 31*a*, is made of a metal, such as stainless steel, to allow heat to be easily transferred to each of the ice making parts 31*a*.

An engaging projection 31*b* is projected from an inside portion of each of the tray cells 31 to be subject to the power transmitted from the drive pulley 10*a*. Further, engaging holes 12 are provided on outer circumferential surfaces of the drive and driven pulleys 10*a* and 10*b* at regular intervals to engage with the engaging projections 31*b*. Thus, when the power is transmitted from the drive pulley 10*a* to the tray cells 31 by an engagement of the engaging projections 31*b* with the engaging holes 12, the tray cells 31 rotate around the drive and driven pulleys 10*a* and 10*b*.

According to the present invention, the ice maker also comprises heat/light generating units 40. The heat/light generating units 40 are located in an interior of the ice making conveyor 30 to transmit energy in the form of heat and light. Further, a reflecting member 50 is provided at a predetermined position around the heat/light generating units 40, and reflects the heat and the light generated from the heat/light generating units 40, to guide the heat and the light to the tray cells 31 disposed under the heat/light generating units 40. Therefore, the reflecting member 50 concentrates the light on a desired portion of the ice making conveyor 30 to be heated, using a characteristic of light that is more easily reflected than heat, to allow the energy to be efficiently applied to the desired portion, while minimizing the amount of the energy transmitted to the tray cells 31 located above the heat/light generating units 40.

According to the embodiment of the present invention, each of the heat/light generating units 40 comprises a halogen lamp which is used as a light source. The halogen lamp maintains an interior temperature of 250° or higher so as not to be blackened by tungsten evaporated from a filament provided in the halogen lamp. Thus, the halogen lamp is capable of generating light and heat.

The reflecting member 50 comprises an arc-shaped cross-section to cover upper and side portions of the heat/light generating units 40. Thus, the reflecting member 50 reflects the light generated by the heat/light generating units 40and guides the light below the heat/light generating units 40.

The support bracket 11 is mounted at both ends thereof to an interior of a cooling compartment to install the ice maker in the cooling compartment. According to the embodiment of the present invention, a mounting bracket 60 is included to hold both sides of the support bracket 11, thus supporting the ice making conveyor 30 in the cooling compartment.

An ice storage tray 70 is located under the ice making conveyor 30 to store ice cubes formed in the ice making parts 31*a*. A water supply pipe 80 is located above the ice making conveyor 30 to supply water to the tray cells 31.

The operation and operational effects of the ice maker according to the present invention will be described in the following in detail with reference to the attached drawings.

First, water is supplied through the water supply pipe 80 to the ice making parts 31*a* of the tray cells 31 which face upward. Since the ice maker is installed in the cooling compartment of a refrigerator, cool air is continuously supplied to the water which is contained in the ice making parts 31*a*. Thus, after a predetermined period, the water in the ice making parts 31*a* freezes into ice.

The ice cubes must be removed from the tray cells 31 to be used. In order to remove the ice cubes from the tray cells 31, the ice making conveyor 30 is operated by the drive unit 20, and the drive and driven pulleys 10*a* and 10*b*. In a detailed description, when electricity is applied to the drive unit 20, the drive pulley 10*a* rotates. At this time, the engaging holes 12 included on the outer circumferential surface of the drive pulley 10*a* engage with the engaging projections 31*b* provided on the tray cells 31 to move the ice making conveyor 30. As a result of the movement of the ice making conveyor 30, the ice making parts 31*a* containing the ice cubes face downward.

In such a state, when electricity is applied to the heat/light generating units 40, the heat/light generating units 40 placed in the interior of the ice making conveyor 30 transmit the energy in the form of heat and light. Therefore, light downwardly irradiated from the heat/light generating units 40 is directly applied to the tray cells 31 located under the heat/light generating units 40. On the other hand, light upwardly and laterally irradiated from the heat/light generating units 40 is reflected by the reflecting member 50 that covers the upper and side portions of the heat/light generating units 40, thus being applied to the tray cells 31 located under the heat/light generating units 40.

Most of the light energy generated by the heat/light generating units 40 is transmitted to the tray cells 31 located under the heat/light generating units 40. The light energy is converted into the heat energy to remove the ice cubes from the ice making parts 31*a*.

The ice cubes of the tray cells 31 located under the heat/light generating units 40 are heated by the heat and light generated by the heat/light generating units 40. Therefore, surfaces of the ice cubes which are in contact with the tray cells 31 defining the ice making parts 31*a* are heated, and eventually melted, thus breaking a holding force. The ice cubes fall due to gravity from the ice making parts 31*a* to be stored in the ice storage tray 70.

As is apparent from the above description, the present invention provides an ice makerhaving heat/light generating units to generate heat and light, and a reflecting member to downwardly reflect the heat and the light generated from the heat/light generating units, allowing the heat to be concentrated on ice making parts of tray cells that are located under the heat/light generating units, while minimizing the amount of the heat transmitted to tray cells located above the heat/light generating units Therefore, the ice cubes are efficiently removed from the ice making parts located under the heat/light generating units.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. An ice maker, comprising:

first and second pulleys spaced apart from each other;

a drive unit to rotate the first and second pulleys;

an ice making conveyor wrapped around the first and second pulleys, and having ice making parts concavely formed to contain water therein;

a heat/light generating unit located in an interior of the ice making conveyor to generate heat and light; and a reflecting member to downwardly reflect the heat and the light generated from the heat/light generating unit.

2. The ice maker of claim 1, wherein the heat/light generating unit comprises a halogen lamp to generate the heat and light.

3. The ice maker of claim 1, wherein the reflecting member comprises an arc-shaped cross-section to cover upper and side portions of the heat/light generating unit, to downwardly guide the heat and the light generated from the heat/light generating unit.

4. The ice maker of claim 1, wherein the drive unit transmits power and the first pulley comprises a drive pulley which is rotated by the power transmitted from the drive unit; and the second pulley comprises a driven pulley which is rotated by the power transmitted from the first pulley through the ice making conveyor.

5. The ice maker of claim 4, further comprising a support bracket located between the drive pulley and the driven pulley, wherein the drive pulley and the driven pulley are respectively located at opposite ends of the support bracket to be spaced apart from each other by a predetermined distance.

6. The ice maker of claim 4, wherein the ice making conveyor further comprises tray cells having the ice making parts, wherein the tray cells are hinged to each other to form the ice conveyor in a closed-loop shape.

7. The ice maker of claim 6, wherein the ice making parts comprises a metal to allow heat to be transferred to each of the ice making parts.

8. The ice maker of claim 6, further comprising an engaging projection projected from an inside portion of each of the tray cells to be subjected to the power transmitted from the drive pulley.

9. The ice maker of claim 8, further comprising engaging holes included on outer circumferential surfaces of the drive and driven pulley at regular intervals to engage with the engaging projections.

10. The ice maker of claim 1, wherein the reflecting member is included at a predetermined position around the heat/light generating units.

11. The ice maker of claim 2, wherein the halogen lamp maintains an interior temperature of at least 250° and is capable of generating light and heat.

12. The ice maker of claim 5, wherein the support bracket is mounted at ends thereof to an interior of a cooling compartment to install the ice maker in the cooling compartment.

13. The ice maker of claim 12, further comprising a mounting bracket included to hold sides of the support bracket to support the ice making conveyor in the cooling compartment.

14. The ice maker of claim 1, further comprising an ice storage tray located under the ice making conveyor to store ice cubes formed in the ice making parts.

15. The ice maker of claim 1, further comprising a water supply pipe located above the ice making conveyor to supply water to the ice making parts.

16. The ice maker of claim 6, wherein the reflecting member concentrates the light on a desired portion of the ice making conveyor to be heated, to allow energy to be efficiently applied to the desired portion, while minimizing an amount of the energy transmitted to the tray cells located above the heat/light generating units.

17. An ice maker, comprising:

a drive pulley and a driven pulley spaced apart from each other;

a drive unit to rotate the drive pulley and the driven pulley;

an ice making conveyor wrapped around the drive and driven pulleys;

tray cells having ice making parts, and hinged to each other to form the ice making conveyor;

heat/light generating units located in an interior of the ice making conveyor to generate heat and light; and a reflecting member to downwardly reflect light which is upwardly and laterally irradiated from the heat/light generating units.

18. A method of making ice cubes in an ice maker having an ice making conveyor, heat/light generating units and ice making parts, the method comprising:

forming ice cubes in the ice making parts;

operating the ice making conveyor by a drive unit;

transmitting heat and light from the heat/light generating units;

applying light downwardly generated from the heat/light generating units, to the ice making parts;

downwardly reflecting light which is upwardly and laterally irradiated from the heat/light generating units; and converting the light to heat and removing the ice cubes from the ice making parts.

19. The ice maker of claim 17, wherein the heat/light generating units and the reflecting member allow the ice cubes to be removed from the ice making parts located under the heat/light generating units, and minimize an amount of energy transmitted to the ice making parts located above the heat/light generating units.

* * * * *

UNITED STATES PATENT AND TRADEMARK OFFICE

CERTIFICATE OF CORRECTION

PATENT NO. : 6,945,057 B2
APPLICATION NO. : 10/790701
DATED : September 20, 2005
INVENTOR(S) : Ji Sick Hwang et al.

It is certified that error appears in the above-identified patent and that said Letters Patent is hereby corrected as shown below:

On the title page, (75) Inventors, change "Kwangiu" to --Kwangju-- for the first, second, third and fourth inventors.

On the title page, (56) References Cited, U.S. Patent Documents, column 2, line 4, change "Mateck" to --Maleck--

Signed and Sealed this

Eleventh Day of July, 2006

JON W. DUDAS
*Director of the United States Patent and Trademark Office*